US006880647B2

(12) United States Patent
Villareal

(10) Patent No.: US 6,880,647 B2
(45) Date of Patent: Apr. 19, 2005

(54) CHASSIS FOR DOWNHOLE DRILLING TOOL

(75) Inventor: Steven G. Villareal, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 73 days.

(21) Appl. No.: 10/249,838

(22) Filed: May 12, 2003

(65) Prior Publication Data

US 2004/0226753 A1 Nov. 18, 2004

(51) Int. Cl.[7] ..... E21B 47/02

(52) U.S. Cl. ..... 175/40; 175/45; 166/250.11

(58) Field of Search ..... 175/40, 45, 46, 175/48, 50; 166/250, 254.2, 250.07, 250.11, 66.7

(56) References Cited

U.S. PATENT DOCUMENTS

| | | | | |
|---|---|---|---|---|
| 3,598,156 | A | | 8/1971 | Ulmer et al. |
| 3,798,011 | A | | 3/1974 | Sharp, Jr. |
| 3,859,058 | A | | 1/1975 | Anthony et al. |
| 4,436,118 | A | | 3/1984 | Garrett |
| 4,544,523 | A | | 10/1985 | McCollough et al. |
| 4,679,294 | A | | 7/1987 | Lomax et al. |
| 4,881,406 | A | * | 11/1989 | Coury ..... 73/152.03 |
| 4,943,489 | A | | 7/1990 | Kuhara et al. |
| 4,977,034 | A | | 12/1990 | Wang |
| 5,265,793 | A | | 11/1993 | Usui et al. |
| 5,517,540 | A | | 5/1996 | Marlowe et al. |
| 5,529,108 | A | | 6/1996 | Newkirk et al. |
| 5,620,805 | A | | 4/1997 | Ogawa et al. |
| 5,815,790 | A | | 9/1998 | Billgren et al. |
| 6,060,180 | A | | 5/2000 | Ishitsuka et al. |
| 6,085,800 | A | | 7/2000 | Usui |
| 6,148,866 | A | | 11/2000 | Quigley et al. |
| 6,148,912 | A | * | 11/2000 | Ward ..... 166/250.07 |
| 6,203,752 | B1 | | 3/2001 | Bewlay et al. |
| 6,293,311 | B1 | | 9/2001 | Bushi et al. |
| 6,309,762 | B1 | | 10/2001 | Speckert |
| 6,429,784 | B1 | * | 8/2002 | Beique et al. ..... 340/853.2 |
| 6,666,285 | B1 | * | 12/2003 | Jones et al. ..... 175/50 |

* cited by examiner

*Primary Examiner*—Frank Tsay
(74) *Attorney, Agent, or Firm*—Timothy W. Curington; Brigitte Echols

(57) ABSTRACT

The present invention relates to a chassis for a downhole drilling tool. The chassis is positionable in a drill collar of a downhole tool and includes a first portion and a second portion. The first portion defines a passage for the flow of drilling fluid through the drill collar. The first portion is made of a high machinable material and has at least one cavity therein for housing instrumentation. The second portion is positioned about the first portion such that the first portion is isolated from the drilling fluid. The second portion is made of a high strength and/or an erosion resistant material. A HIP process may be used to metallurgically bond the materials together to from the chassis.

21 Claims, 4 Drawing Sheets

FIG.3
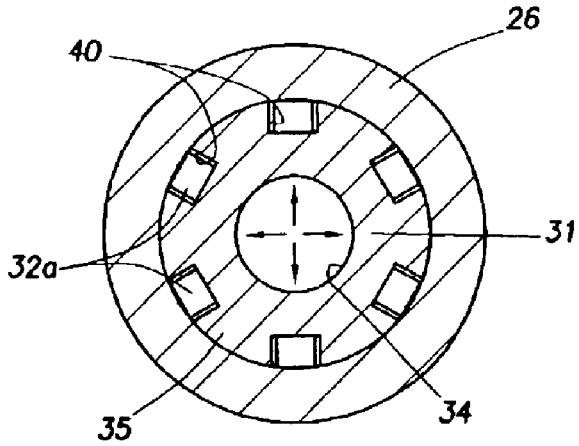
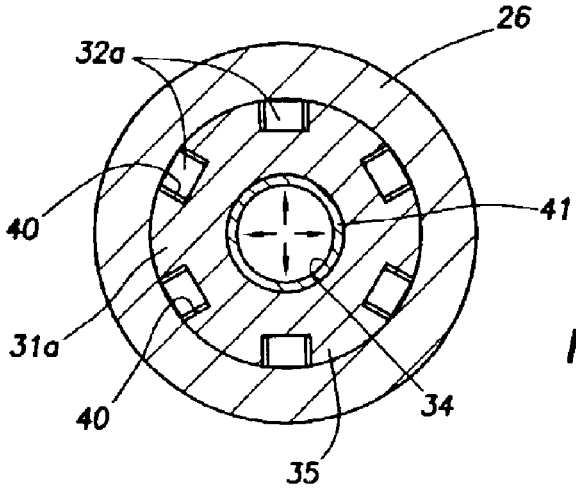
FIG.4
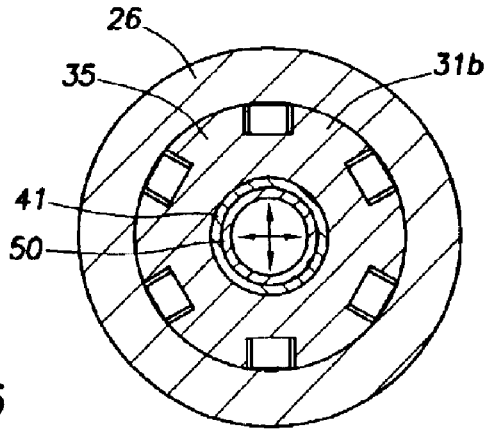
FIG.5

FIG.6
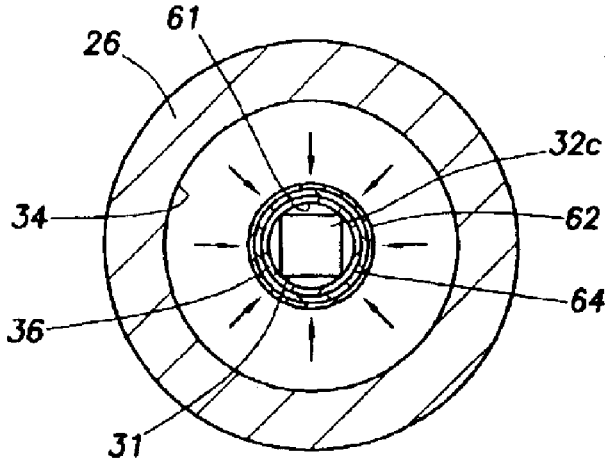
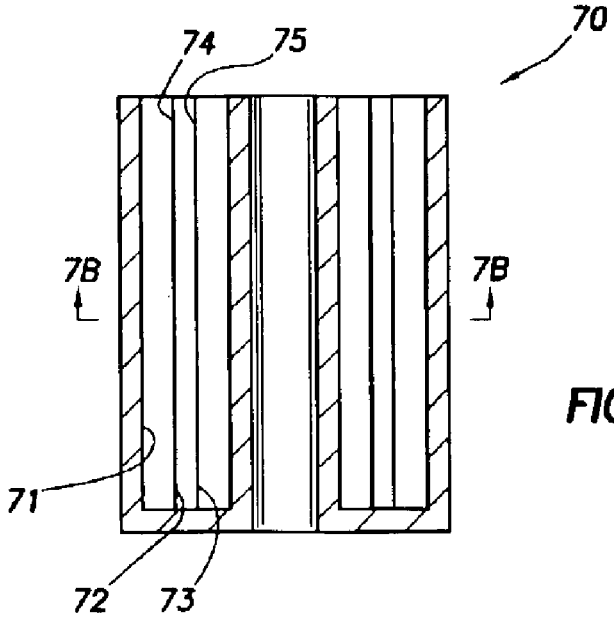
FIG.7A
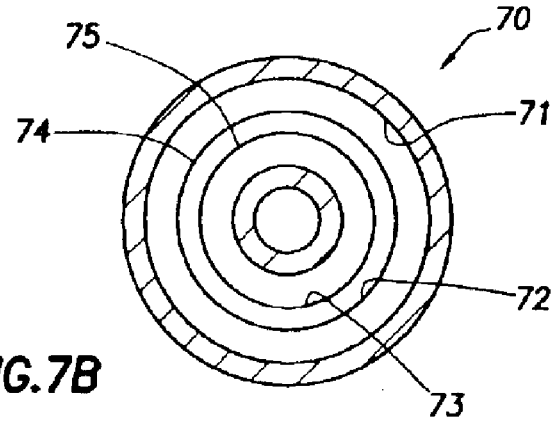
FIG.7B

CHASSIS FOR DOWNHOLE DRILLING TOOL

BACKGROUND OF INVENTION

The present invention relates to machinable components for downhole drilling tools. More particularly, the present invention relates to a machinable component for a downhole drilling tool that maintains its structural integrity when exposed to high pressure environments.

Downhole operations, such as those performed in the drilling and/or production of hydrocarbons, are typically performed at extreme depths and at extremely high pressures and temperatures. Such conditions can cause difficulty in performing downhole operations, and often cause damage to wellbore equipment. It is, therefore, necessary that downhole equipment be capable of performing under such difficult conditions.

Downhole drilling tools are subject to external downhole pressures generated by the wellbore and surrounding formations. Additionally, these drilling tools are exposed to internal pressures resulting from high pressure drilling fluids that are pumped through the downhole tool during drilling operations. High pressure drilling fluid is circulated from the surface down through the drilling tool and to the drill bit. The fluid travels through the drill bit and returns to the surface carrying cuttings from the formation.

FIG. 1 illustrates a conventional drilling rig and drill string. Land-based rig 180 is positioned over wellbore 110 penetrating subsurface formation F. The wellbore 110 is formed by rotary drilling in a manner that is well known. Drill string 190 is suspended within wellbore 110 and includes drill bit 170 at its lower end.

Drill string 190 further includes a bottom hole assembly, generally referred to as BHA 150. The BHA may include various modules or devices with capabilities, such as measuring, processing, storing information, and communicating with the surface, as more fully described in U.S. Pat. No. 6,230,557 assigned to the assignee of the present invention, the entire contents of which are incorporated herein by reference. As shown in FIG. 1, BHA 150 is provided with stabilizer blades 195 extending radially therefrom.

The drilling string has an open internal channel 100 through which the high pressure drilling fluid/mud 120 flows from the surface, through the drillstring and out through the drill bit. Drilling fluid or mud 120 is pumped by pump 140 through the internal channel 100, inducing the drilling fluid to flow downwardly through drill string 190. The drilling fluid exits drill string 190 via ports in drill bit 170, and then circulates upwardly through the annular space 130 between the outside of the drill string and the wall of the wellbore as indicated by the arrows. In this manner, the drilling fluid lubricates drill bit 170 and carries formation cuttings up to the surface as it is returned to the surface for recirculation.

The mud column in drillstring 190 may also serve as the transmission medium for carrying signals containing downhole parameter measurements to the surface. This signal transmission is accomplished by the well-known technique of mud pulse generation whereby pressure pulses are generated in the mud column in drillstring 190 representative of sensed parameters down in the well. The drilling parameters are sensed by instruments mounted in the BHA 150 near or adjacent to the drill bit. Pressure pulses are established in the mud stream within drillstring 190, and these pressure pulses are received by a pressure transducer and then transmitted to a signal receiving unit which may record, display and/or perform computations on the signals to provide information of various conditions down the well.

Due to the harsh conditions for downhole operations, the design of downhole pressure housings is typically dictated by the strength required to withstand the high pressure, high temperature and shock conditions of the drilling process. In the assembly structure design process, materials are typically selected based on the loading requirements, which include high pressure, axial compression, and the material weakness as a result of temperature, bending, and shock during the drilling process. High strength materials may be used for these high-pressure applications. Unfortunately, these materials will have a low machinability when compared to conventional materials such as regular stainless steel.

During drilling operations, it is common for the down hole assembly to be in an environment where the outside diameter of the tool is exposed to low pressure and the internal portions of the tool (particularly where the drilling fluid flows) are exposed to high pressure. Therefore, it is necessary to design a structure that maintains both its internal and external integrity when simultaneously exposed to different pressures during drilling operations. One solution would be to select a single high strength material of a given thickness for this application. However, in addition to the necessity for the tool to be able to withstand these drilling pressures, the tool may also support potentially delicate instruments, such as circuit boards used in measurement while drilling (MWD) operations. The process of installing such instruments involves complicated machining operations. During the component mounting process, it may be necessary to create deep milled pockets within the downhole tool and drill threaded holes in order to adequately secure all of the components. In a typical MWD component, it may be necessary to drill hundreds of holes to secure the circuit boards.

As a result of the various conditions under which the tool must operate and the internal design of the tool, there are some conflicting requirements for the construction of this tool. The drilling tool is provided with an internal pressure housing or chassis removably positioned within the drill collar or BHA. In order to withstand the environmental loading, it is typically necessary to use a high strength material to form the chassis. However, high strength materials typically have a low machinability because surface hardness is proportional to strength. Materials that are more amenable to machining may not have the required strength to withstand the high pressures encountered during drilling operations. As a result of the high-pressure environment in which the tool will operate, the common practice is to use low machinable superalloy materials and endure time consuming and/or low efficiency machining processes in order to create the mounting surfaces for the instruments.

Although high strength alloys are necessary for use in high-pressure environments, as previously mentioned, these alloys also take longer to machine. This longer machining time is often the result of reducing the feed rate and turning speeds while machining high surface hardness materials, in order to minimize wearing and chattering of the cutting tools. Using these alloys for parts that require considerable milling and have numerous tapped holes, therefore, adversely affects the manufacturing cost. In addition, during the milling process used to create these pockets in the chassis of the downhole tool, the material is machined down a required depth needed to mount the instrument such that it can properly fit in the chassis. However, the chassis usually must maintain a minimum thickness, and, therefore, a maximium machining depth. The design requires a minimum internal thickness of the material in order to assure maximum strength against the high pressures of the drilling fluid. If during machining, this minimum thickness is exceeded, it may be necessary to scrap the entire chassis part and begin the entire machining process again. Also, if there are mistakes during the machining operation, the part may be scrapped because subsequent repairs typically affect the integrity of the chassis.

A review of the implementation of a tool in a downhole environment indicates that stress is not uniformly distributed through the cross-section of the downhole tool. As a result, high strength (or high yielding) material is not required through the entire cross section of the chassis. In fact, material located beyond a calculated internal diameter from the surface exposed to high pressure can have a lower yield strength and still provide enough structural support to function reliably. Manufacturing a raw material that has the optimal properties located through the cross section can reduce cost and add design flexibility without affecting reliability. Since different portions of the chassis are exposed to various pressures, one alternative could be to construct the chassis from multiple metals based on the pressure and machining requirements.

Various techniques have been developed for providing materials exposed to harsh environments. For example, U.S. Pat. No. 6,309,762 issued to Speckard describes an article of manufacture with a wear resistant cylindrical surface positioned in a channel therethrough, and U.S. Pat. No. 4,544,523 issued to McCullough et al. describes a method of producing an alloy article by compacting metal particles along an internal channel thereof. Another example involving a surface oil field operation is U.S. Pat. No. 6,148,866 issued to Quigley et al. Quigley teaches a spoolable composite tube formed of polymer-based materials for use in high strength tubes that act as pressure housings. In these examples, components are not mounted to the surfaces of the wear resistant or high strength materials. Additionally, these tubes are not designed to take full differential pressure, but only the pressure difference between the annulus and the ID of the tube.

Despite the development of such techniques for dealing with harsh conditions, there remains a need to provide materials capable of enduring downhole conditions while reducing the difficulties encountered in the manufacture and/or machining process.

For downhole drilling operations, not every location along the downhole assembly chassis is exposed to the same pressures during drilling operations. In fact, the outer surface of a chassis, which requires machining in order to mount the instruments, is only exposed to atmospheric pressure. Typically, the internal structure of the assembly, where the drilling fluid flows and which has reduced machining requirements, is exposed to the high pressures. Accordingly, there remains a need for a BHA that can be constructed with material(s) capable of withstanding the environmental loading, but also having high machinability. It is desirable that such a tool be more easily manufactured, more easily maintained, have reduced wear on the tools used to machine the assembly, and extend the life of the manufacturing equipment (mills, taps, etc.) It is also desirable that the tool provide one or more of the following benefits, among others: endurance in even high pressure drilling operations, compatibility with drilling fluids resistance to pressure, ease of manufacture and/or assembly, ease to repair, and resistance to erosion.

SUMMARY OF INVENTION

To address the problem of manufacturing a high strength tool that is easily machinable, the approach of the present invention is to construct a tool chassis comprised of a high strength metal to act both as a drilling fluid conduit and as an internal pressure housing to protect against the high-pressure fluid. The tool would also comprise high machinability outer metal surrounding the high strength metal core. The outer metal comprises a metal more amenable to machining in order to incorporate instruments and components in this outer metal material with a lower manufacturing cost. In this approach, the proposed invention may be formed as a fully consolidated part and, therefore, all the loads may be shared.

In at least one aspect, the present invention relates to a chassis for a downhole drilling tool. The chassis is positionable in a drill collar of a downhole tool and includes a first portion and a second portion. The first portion defines a passage for the flow of drilling fluid through the drill collar. The first portion is made of a high machinable material and has at least one cavity therein for housing instrumentation. The second portion is positioned about the first portion such that the first portion is isolated from the drilling fluid. The second portion is made of a high strength material and/or an erosion resistant material. A Hot Isostatic Press (HIP) process may be used to bond the materials together to form the chassis.

In another aspect, the invention relates to a chassis for a downhole drilling tool. The chassis includes a base and a liner. The base defines a passage for the flow of drilling fluid through the drill collar. The base is made of a high machinable material and has at least one cavity therein for housing instrumentation. The liner is positioned about the base for isolating the base from the drilling fluid. The liner is made of a high strength material and/or an erosion resistant material.

Other aspects of the invention will be appreciated upon review of the disclosure provided herein.

BRIEF DESCRIPTION OF DRAWINGS

FIG. 3 is a horizontal cross-section view of the BHA and chassis of FIG. 2 taken along line 3—3.

FIG. 4 is an alternate embodiment the BHA and chassis of FIG. 3 having a high strength layer.

FIG. 5 is an alternate embodiment the BHA and chassis of FIG. 3 having an erosion resistant ring and a high strength layer.

FIG. 6 is a horizontal cross-section view of the BHA and chassis of FIG. 2 taken along line 6—6.

FIG. 7A is a longitudinal cross-sectional view of a container for use in a HIP manufacturing process.

FIG. 7B is a horizontal cross-sectional view of the container of FIG. 7A taken along line 7B—7B.

DETAILED DESCRIPTION

Figure 1:
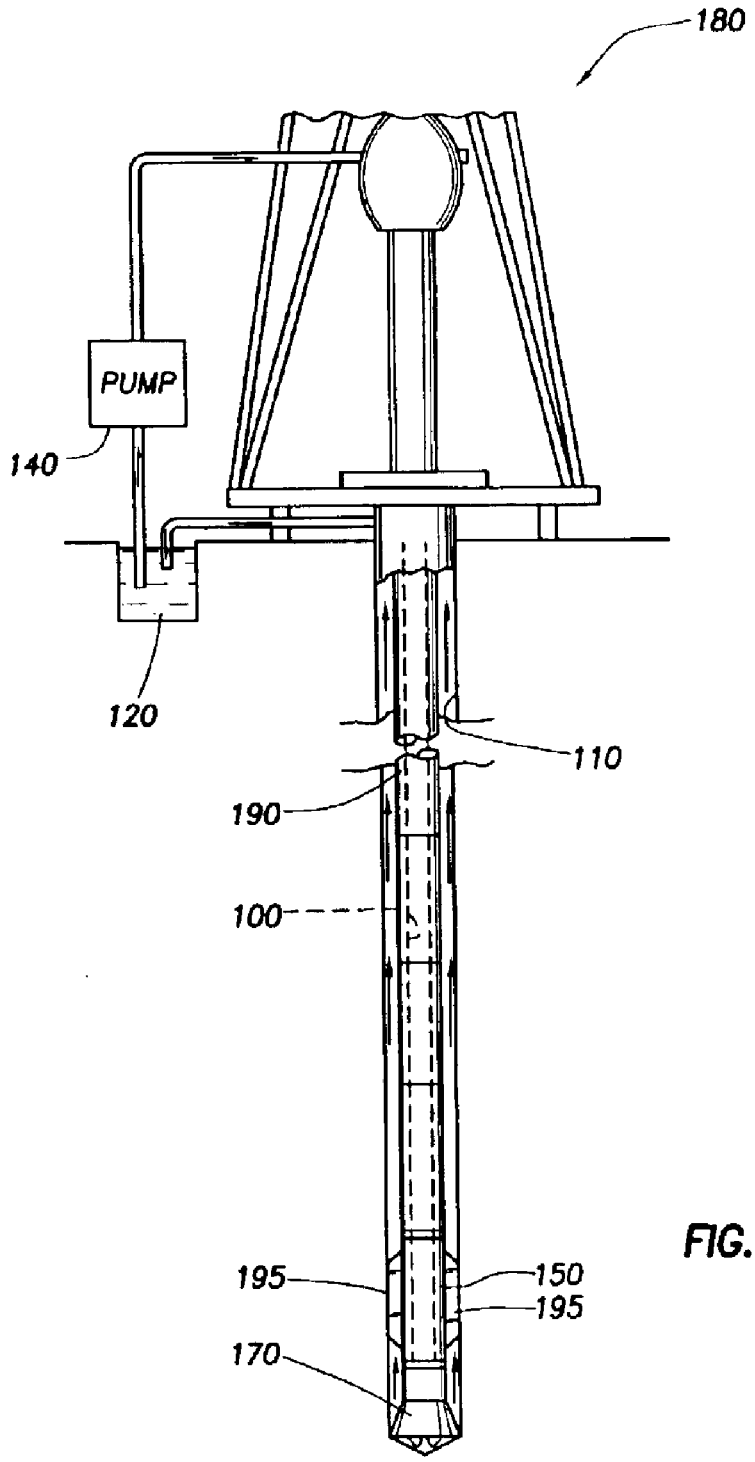
FIG. 1 is an elevational view, partially in section and partially in block diagram, of a conventional drilling rig, drill string and BHA employing the present invention.
Figure 2:
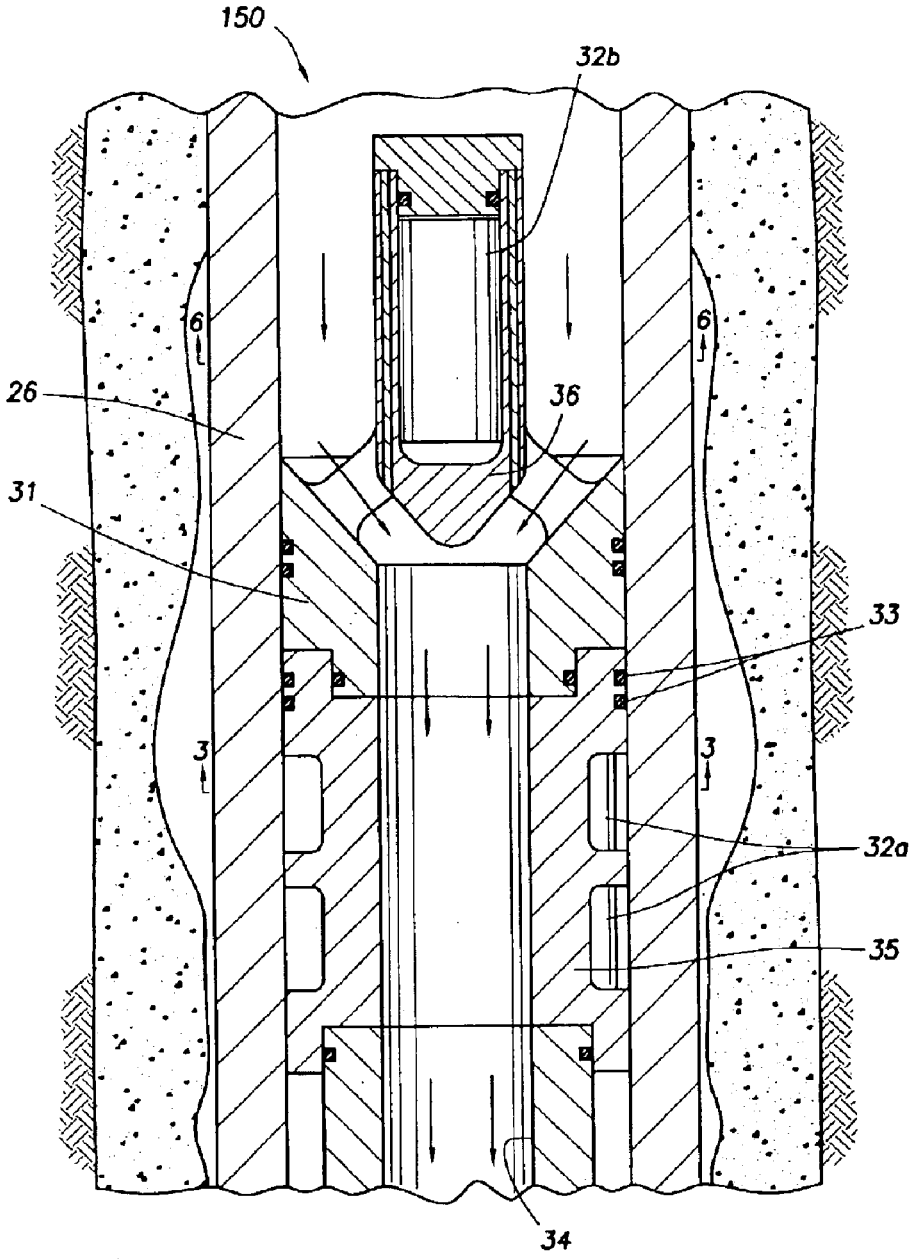
FIG. 2 is a longitudinal, cross-section view of the BHA of FIG. 1 depicting a chassis therein.

FIG. 2 depicts a cross-sectional view of a BHA 150 usable as part of a downhole drilling tool, such as the drilling tool depicted in FIG. 1. The arrows depict the flow of drilling fluid as it passes through the BHA 150. The BHA includes a drill collar 26 and a chassis 31 therein. Measuring instruments, electronics and/or components 32*a* and 32*b* are mounted onto various portions of the chassis. The chassis, sometimes referred to as pressure housing or pressure barrel, has an annular portion 35 and a mandrel portion 36 that house electronics, instruments and/or components 32*a* and 32*b*, respectively. Seals 33 prevent fluids from flowing into the chassis. An internal passage 34 enables drilling fluid to flow from the surface, through the BHA and to the drill bit.

During the construction of the chassis, the instruments 32*a* and. 32*b* are typically inserted into various portions of the chassis, and the chassis is then inserted into the drill collar 26. In this chassis insertion operation, atmospheric pressure is trapped in the assembly between the chassis and drill collar, and within the interior of the mandrel portion 36 of the chassis. In this configuration, the components 32*a* mounted on and 32*b* mounted in the chassis are exposed to atmospheric pressure. However, the pressure of the drilling fluid flowing through the internal passage 34 is extremely high, on the order of 20,000 psi. To operate in the extreme high-pressure differential, the chassis is typically constructed from a material that is sufficiently strong to withstand these extreme fluid pressures and maintain the physical integrity of the chassis.

Referring to FIG. 3, a cross-section view of the BHA 150 of FIG. 2 taken along line 3—3 is depicted. In this embodiment, the chassis 31 is made of a homogeneous material and mounted in the drill collar 26. The annular portion or base 35 of the chassis 31 adjacent the drill collar 26 defines cavities 40 therebetween. One or more instruments 32*a* may be housed in these cavities. The instruments 32*a* are typically surface mounted onto the tool chassis. Internal passage 34 extends through the central portion of the chassis 31 to allow fluid flow therethrough.

The annular portion 35 of chassis 31 of FIG. 3 preferably comprises a material that can withstand exposure to the very high pressures of the fluid in passage 34 as depicted by the arrows. Preferably, the material forming the chassis 31 is capable of withstanding exposure to differential pressure between cavity 40 and high pressure fluid in passage 34 without plastic deformation and still fit within the envelope of the drill collar. It is further preferable that the material withstands such conditions where the thickness between passage 34 and cavities 40 is reduced. Examples of materials that may be used to withstand the drilling operation may include materials, such as steel, stainless steel (ie. 316), nickel-based superalloys (ie. Inconel), cobalt alloys (ie. NP35N), copper-nickel alloys (ie. monels), titanium and other high strength materials. While it is desirable that the material be as strong as possible, it is also desirable that the material be sufficiently machinable to permit easier manufacture and/or machining of the chassis.

Materials with high strength sufficient to withstand the environmental loading are often difficult to machine, particularly where the machining requires that cavities be formed to receive instrumentation. For example, for the same conditions, the time required for a turning operation and/or milling using a high strength material, such as Inconel, takes much longer than the time required for machining a low strength material, such as stainless steel. Likewise, the time required for drilling operations for Inconel is typically much longer than for stainless steel.

Referring to FIG. 4, an alternate embodiment of the chassis 31*a* positioned in the drill collar 26 is provided. The chassis 31*a* of FIG. 4 is the same as the chassis of FIG. 3, except that a central ring or liner 41 is positioned along the inner diameter of the annular portion 35 about passage 34. Preferably, the central ring 41 is metallically bonded to the inner diameter of inner portion 35. Central ring 41 is adapted to endure high pressure drilling fluid flowing through the passage 34. Central ring 41 preferably comprises a high yield strength and/or corrosion resistant material, such as a chrome-nickel superalloy. In some situations, it may be desirable to select a material that is non-magnetic since it may affect the measurement instrumentation. This consideration would be related to the particular tool and application of that tool.

Central ring 41 may be used to provide additional reinforcement against the high pressure in passage 34 (indicated by the arrows). Preferably, the ring 41 is thick enough to contain the pressure in passage 34 without yielding. Because the annular portion 35 is typically exposed to pressures that are atmospheric and/or much lower than the pressure in passage 34, the outer diameter of annular portion 35 may be made of lower strength materials. The use of lower strength material for this annular portion may also be used to increase machinability of the chassis for the creation of cavities and/or the mounting of instrumentation 32*a* therein. The annular portion may, therefore, be provided with a low strength and more machinable material than the material used for ring 41. A low strength material substantially reduces the processing time of machining the chassis. Such low strength materials may include, for example, alloy steel or stainless steel.

Still referring to FIG. 4, the annular portion 35 of the chassis is machined to form the cavities 40 for receipt of the instruments 32*a*. The cavities can have varying depths and length to adapt to the size of the component. The larger the component, the more machining that is required to create the cavities 40 to receive the components. Each cavity extends through the outer surface of the annular portion 35 and inward toward ring 41. Preferably, the cavity extends into the chassis a sufficient distance for the electronics to be positioned in the cavity between the drill collar and the chassis without interference with the drill collar. The cavity 40 preferably extends from the outer diameter of the annular portion 35 a distance into the annular portion 35. The instruments 32*a* may be secured in the cavities 40 of the annular portion 35 by threaded screws (not shown).

FIG. 5 illustrates another embodiment of the chassis 31*b*. This embodiment is similar to the chassis 31*a* described in FIG. 4, except that the annular portion 35 chassis 31*b* is further provided with an additional erosion resistant layer 50 positioned inside ring 41. Layer 50 is preferably metallergically bonded along the inside ring. This layer 50 provides an additional barrier to erosion caused by the constant flow of abrasive fluids at high pressure and serves to prevent wear to the chassis. The erosion resistant layer may be made of various materials such as tungsten alloys, cobalt alloys or other erosion resistant materials These materials provide additional support and strength to the chassis.

Referring now to FIG. 6, a cross-section view of the BHA 150 of FIG. 2 taken along line 6—6 is depicted. In this embodiment, the mandrel portion 36 of the chassis 31 is positioned centrally within the drill collar 26 with passage 34 therebetween. One or more electronics or instruments 32*b* are housed within a chamber 61 within mandrel portion 36 of the chassis 31. Passage 34 extends about the mandrel portion 36 of chassis 31 to allow fluid flow therethrough.

Mandrel portion 36 of chassis 31 is preferably provided with an erosion resistant outer ring or layer 62 and a high strength layer 64 surrounding the outer surface of mandrel portion 36. High strength layer 64 is adapted to endure high pressure drilling fluid flowing through the passage 34. Layer 64 preferably comprises a high yield strength and corrosion resistant material, such as Inconel, nickel-chrome alloys, and/or copper-nickel alloys. Layer 64 may be used to provide additional reinforcement against the high pressure flowing through passage 34. In some situations, it may be desirable to select a material that is non-magnetic since it may affect the measurement instrumentation.

Outer ring 62 is preferably an erosion resistant layer, such as layer 50 of FIG. 5. Layer 62 may be used to isolate the mandrel portion 36 of the chassis from the high pressures in passage 34 and/or the flow of fluid therethrough. The mandrel portion 36 is typically machined in order to mount instrumentation 32*a* therein. Like the annular portion 35, the mandrel portion may, therefore, be provided with a low strength material and/or a material more machinable than the material used for outer ring 62 and/or layer 64. A low strength material may be used for the mandrel portion to substantially reduce the machining process.

The mandrel portion 36 of the chassis is machined to form a cavity 61 for receipt of the instruments 32*b*. Preferably, the cavity extends into the chassis a sufficient distance for the instruments to be positioned in the cavity a distance from the layer 64 and outer ring 62. The instruments 32*b* may be secured in the cavity 61 by threaded screws (not shown). The high strength layer 64 is positioned inside outer ring 62. This layer 64 is preferably made of a high yield strength material, such as that used for ring 41, to provide additional support to the mandrel portion 36.

While FIGS. 3—6 depict various techniques for providing additional strength and/or erosion resistance to the chassis 31, it will be appreciated that such erosion resistance rings and/or layers may be provided about various portions of the chassis as desired. Preferably, the portions of the chassis that require machining are provided with a low strength material while portions exposes to high pressure, abrasive fluids, heat and/or downhole conditions susceptible to wear or erosion are provided with such additional reinforcement and/or protection.

In manufacturing the chassis using multiple metals, a technique known as Hot Isostatic Pressing (HIP) may be used. HIP is often used for correcting defects such as cracks, pores or other voids in metallic materials. The HIP treatment has also been used to remove defects in parts of expensive material, for example gas turbine parts such as turbine blades of titanium or other so-called super-alloys. The HIP technique is typically carried out in a pressure chamber at high temperature with an inert gas as the pressure medium.

The HIP process begins with a container of powdered metal. A vacuum is created in this container. This container is then put into a furnace With high pressure such as 14000 psi and an elevated temperature (ie. 1400° C.) based on the type of metal in the furnace. The exposure of the material to the combination of pressure and temperature consolidates the powder metal into a solid. Metallurgical bonding occurs at the junctions of the metals. For construction of the chassis as provided herein, a container with one or more compartments may be used.

FIGS. 7A and 7B depict a container 70 usable for forming a chassis, such as the chassis 31*b* of FIG. 5 using the HIP process. The container 70 has three compartments 71, 72 and 73. Separating the three compartments are thin steel layers 74 and 75. In the process, calculations are made to determine the appropriate thickness of each layer of the tool prior to the manufacturing of the tool. The container is then divided into compartments according to the calculations for each layer. Powdered metal is then added to the container in the appropriate compartment for the corresponding layer.

For example, the material forming the erosion resistant layer 50, such as Stellite®, would be in compartment 73. The material forming the high strength ring 41, such as Inconel or other high strength nickel-chrome alloy, would be in component 72. The material forming the annular portion 35, such as 316 stainless steel powder, would be in compartment 71.

After these metals are in the container, the container is vacuum-sealed and placed in a HIPing chamber. Heat and pressure are then applied to the container to cause the materials to bond together. The container is retrieved from the chamber and the outer canister material is machined away. Because the part may deform slightly, the part is often made oversized.

The materials used herein may be manufactured by HIPing different powder metals together within a sealed container. The container can have a hollow or solid center. The HIPing cycle heats and pressurizes the outer surfaces of the container to fully consolidate the powder metal. The fully dense tube or bar can then be cut into the length required for the pressure housing or chassis.

It is an object of the invention to reduce costs by employing expensive high strength material only in portions of the chassis where the additional strength is necessary.

It is an object of the invention to increase the ability to use low strength materials in greater portions of the chassis to facilitate machinability and/or permit weld repairs, without diminishing the strength of the entire chassis.

It is an object of the invention to employ erosion resistant material along flow surfaces to reduce wear.

It is an object of the invention to use high strength inner material to reduce the design circle for a chassis that was designed for a lower yielding material (i.e. Nitronic-50 versus Inconel), thereby allowing the flats to be deeper and therefore provide more clearance for the mounted components.

This invention can be applied to pressure housings that have high pressure on the OD and low pressure on then ID (and vice versa). In addition, material layers could also be selected to have increased thermal conductivity to better transfer heat from components mounted within atmospheric pressure to the drilling fluid.

It is important to note that the present invention has been described in the context of the preferred embodiment for construction and use of the device. Those skilled in the art will appreciate the alternate embodiments of the present invention. Those skilled in the art will also appreciate and recognize that there may be ways to improve upon the design and implementation of the device of the present invention. For example, while HIP is a technique that may be used to manufacture the chassis described herein, other techniques, such as welding or bonding, may also be used to form the chassis. Therefore, it is not desired to limit the invention to the specific construction and implementations described and shown herein. Accordingly, those skilled in the art may make changes and modifications to the device of the present invention that are within the spirit and scope of the present invention as described in this document. The present embodiment is, therefore, to be considered as merely illustrative and not restrictive. The scope of the invention is indicated by the claims that follow rather than the foregoing description, and all changes, which come within the meaning and range of equivalence of the claims, are therefore intended to be embraced therein.

What is claimed is:

1. A chassis for a downhole drilling tool, the downhole drilling tool comprising a drill string having at least one drill collar and a drilling fluid flowing therethrough, the chassis comprising:

a first portion positionable in the at least one drill collar, the first portion defining a passage for the flow of drilling fluid through the drill collar, the first portion made of a high machinable material, the first portion having at least one cavity therein for housing instrumentation; and a second portion positioned about the first portion such that the first portion is isolated from the drilling fluid, the second portion made of one of a high strength material, an erosion resistant material and combinations thereof.

2. The chassis of claim 1 wherein the first portion is made of one of a low strength material, a high machinable material and combinations thereof.

3. The chassis of claim 1 wherein the second portion comprises an erosion resistant layer.

4. The chassis of claim 3 wherein the erosion resistant layer is made of a material selected from the group of tungsten alloy, cobalt alloy and combinations thereof.

5. The chassis of claim 1 wherein the second portion comprises a high strength layer.

6. The chassis of claim 5 wherein the high strength layer is made of a material selected from the group of chrome-nickel alloys.

7. The chassis of claim 1 wherein the second portion comprises an erosion resistant layer made of a material selected from the group of tungsten alloy, cobalt alloy and combinations thereof and a high strength layer made of a material selected from the group of chrome-nickel alloys.

8. The chassis of claim 7 wherein the high strength layer and the erosion resistant layers are bonded together.

9. The chassis of claim 1 wherein the first portion is non-magnetic.

10. The chassis of claim 1 wherein the first and second portions are bonded together.

11. The chassis of claim 1 wherein the first and second portions are bonded together using a HIP process.

12. The chassis of claim 1 wherein the chassis has an inner portion and an outer portion, the outer portion positioned adjacent the drill collar, the inner portion positioned centrally within the drill collar, the passage extending through the outer portion and about the inner portion.

13. The chassis of claim 12 wherein electronics are positioned in one of the outer portion, the inner portion and combinations thereof.

14. The chassis of claim 12, wherein multiple chassis are positioned in the at least one drill collar.

15. A chassis for a downhole drilling tool, the downhole drilling tool comprising a drill string having at least one drill collar and a drilling fluid flowing therethrough, the chassis comprising:

a base positionable in the at least one drill collar, the base defining a passage for the flow of drilling fluid through the drill collar, the base made of a high machinable material, the base having at least one cavity therein for housing instrumentation; and a liner positioned about the base for isolating the base from the drilling fluid, the liner made of one of a high strength material, an erosion resistant material and combinations thereof.

16. The chassis of claim 15 wherein the high machinable material is stainless steel.

17. The chassis of claim 15 wherein the high strength layer is a material selected from the group of chrome-nickel alloys.

18. The chassis of claim 15 wherein the erosion resistant material is selected from the group of tungsten alloy, cobalt alloy and combinations thereof.

19. The apparatus of claim 15 wherein the base is made of a low strength material.

20. The apparatus of claim 17 wherein the high strength material is Inconel.

21. The apparatus of claim 18 wherein the erosion resistant material is Stellite®.

* * * * *